US007480386B2

(12) United States Patent
Ogata

(10) Patent No.: US 7,480,386 B2
(45) Date of Patent: Jan. 20, 2009

(54) AUDIO INFORMATION TRANSFORMING METHOD, VIDEO/AUDIO FORMAT, ENCODER, AUDIO INFORMATION TRANSFORMING PROGRAM, AND AUDIO INFORMATION TRANSFORMING DEVICE

(75) Inventor: Satoshi Ogata, Ichikawa (JP)

(73) Assignee: Matsushita Electric industrial Co., Ltd., Osaka (JP)

( * ) Notice: Subject to any disclaimer, the term of this patent is extended or adjusted under 35 U.S.C. 154(b) by 957 days.

(21) Appl. No.: 10/689,645

(22) Filed: Oct. 22, 2003

(65) Prior Publication Data

US 2004/0119889 A1 Jun. 24, 2004

(30) Foreign Application Priority Data

Oct. 29, 2002 (JP) ..... P.2002-314552

(51) Int. Cl.
*H04R 5/02* (2006.01)

(52) U.S. Cl. ..... 381/310; 381/306; 381/61

(58) Field of Classification Search ..... 381/1, 381/17–18, 306–307, 309–310, 61–62
See application file for complete search history.

(56) References Cited

U.S. PATENT DOCUMENTS

| | | | | |
|---|---|---|---|---|
| 5,199,075 | A | 3/1993 | Fosgate | |
| 5,764,777 | A | 6/1998 | Goldfarb | |
| 5,993,318 | A * | 11/1999 | Kousaki | 463/35 |
| 6,018,698 | A * | 1/2000 | Nicosia et al. | 701/214 |
| 6,118,880 | A | 9/2000 | Kokkosoulis et al. | |
| 6,401,028 | B1 | 6/2002 | Kamiya et al. | |
| 6,574,339 | B1 | 6/2003 | Kim et al. | |
| 6,633,617 | B1 * | 10/2003 | Cooklev | 375/344 |
| 6,694,033 | B1 | 2/2004 | Rimell et al. | |
| 6,975,731 | B1 * | 12/2005 | Cohen et al. | 381/74 |
| 7,027,600 | B1 * | 4/2006 | Kaji et al. | 381/17 |
| 7,113,610 | B1 * | 9/2006 | Chrysanthakopoulos | 381/309 |
| 7,203,327 | B2 | 4/2007 | Kubota | |
| 2003/0032955 | A1 | 2/2003 | Mulier et al. | |
| 2003/0044026 | A1 * | 3/2003 | Chi | 381/94.7 |
| 2003/0118192 | A1 | 6/2003 | Sasaki | |

FOREIGN PATENT DOCUMENTS

JP 5-174147 7/1993

(Continued)

*Primary Examiner*—Vivian Chin
*Assistant Examiner*—Disler Paul
(74) *Attorney, Agent, or Firm*—McDermott Will & Emery LLP

(57) ABSTRACT

The present invention provides an audio information transforming method, a program product, a device, an encoder, and an video/audio format utilized therein, which are capable of providing an audio information by adjusting the Doppler effect caused by movement of the object, in response to change of the listening point. In the invention, a virtual listening point is set at a position different from a basic listening point where a listener listens to a sound of an object, then a velocity of the object observed from the virtual listening point is calculated based on position information of the virtual listening point and position information of the object. Then, an audio frequency of an audio heard at the virtual listening point is changed based on the calculated velocity. For example, the frequency of the sound is increased if the object approaches the virtual listening point, and the frequency is decreased if opposite.

5 Claims, 10 Drawing Sheets

FOREIGN PATENT DOCUMENTS

| | | | |
|---|---|---|---|
| JP | 05-325421 | A | 12/1993 |
| JP | 07-312800 | A | 11/1995 |
| JP | P2000-279646 | A | 10/2000 |
| JP | 2001-169309 | A | 6/2001 |
| JP | P2002-131072 | A | 5/2002 |

* cited by examiner

FIG. 14

| | | |
|---|---|---|
| SCENE | SCENE INFORMATION | ..... |
| | | REDUCED SCALE INFORMATION |
| | | ..... |
| | OBJECT 1 INFORMATION | COORDINATE INFORMATION |
| | | APPEARING TIME |
| | | ..... |
| | ..... | |
| | OBJECT n INFORMATION | |
| | TEXT INFORMATION | |
| | BACKGROUND INFORMATION | |

AUDIO INFORMATION TRANSFORMING METHOD, VIDEO/AUDIO FORMAT, ENCODER, AUDIO INFORMATION TRANSFORMING PROGRAM, AND AUDIO INFORMATION TRANSFORMING DEVICE

BACKGROUND OF THE INVENTION

1. Field of the Invention

The present invention relates to an audio information transforming method, a video/audio format, an encoder, an audio information transforming program, and an audio information transforming device, which are employed in a video/audio format like MPEG (Moving Picture Experts Group) 4 having video information and audio information every object, or a video/audio format like DVD (Digital Versatile Disk) having video information and audio information every scene.

2. Description of the Related Art

In recent years, the video streaming based on the DVD or the broadband is being prosperously carried out, and thus a chance to handle the video/audio format in the home is increased. In particular, since the DVD is spread and the audio apparatuses such as the AV amplifier, etc. become inexpensive, the persons who enjoy the audio in the multiple channels are increased. In the DVD, MPEG 2 is used as the video recording system and Dolby digital (AC-3), DTS (Digital Theater System), linear PCM (Pulse Code Modulation), MPEG audio, or the like is used as the audio recording system. Eight audio streams can be installed into the DVD disk. Thus, if a different sound is loaded on each audio stream respectively, various applications such as dubbing of plural languages, high sound quality playing, commentary, sound track, etc. can be implemented.

Meanwhile, as one of the next generation video/audio formats, there is MPEG 4. In the MPEG 4, the object having video/audio information constituting the scenes that are replayed on the screen is observed with interest, and the motion picture compression can be effectively attained by coding the motion picture every object.

Also, out of the technologies of the motion picture recognizing processing, the technology of correcting the Doppler effect of the sound, which is emitted from the moving object in the image, is set forth in Patent Literature 1, for example.

Patent Literature 1

JP-A-5-174147 (see Paragraph 0013, etc.)

However, in the multi-channel (e.g., 5.1-channel, etc.) audio system for playing the DVD in the prior art, it is impossible to change the listening point obtained by one audio stream. Therefore, the listener can get the hearing feeling only at the listening point at which the listener himself or herself listens to the audio.

In addition, it is desired that the Doppler effect caused by the movement of the object should be adjusted in response to change of the listening point.

The present invention has been made in view of the above circumstances, and it is an object of the present invention to provide an audio information transforming method, a video/audio format, an encoder, an audio information transforming program, and an audio information transforming device, which are capable of changing a listening point freely only by one audio stream to thereby produce the audio environment that enables the listener to feel that such listener is just in the video, and also adjusting the Doppler effect, which is caused by the movement of the object, in response to change of the listening point.

SUMMARY OF THE INVENTION

In order to attain the above object, an audio information transforming method according to at least one embodiment may be applied to a video/audio format in which a screen includes a plurality of objects and each object has video information, position information, and audio information, comprises a virtual listening point setting step of setting a virtual listening point at a position different from a basic listening point that is set as a position at which a listener listens to an audio; a relative velocity calculating step of calculating a relative velocity between the virtual listening point and the object; and an audio frequency transforming step of executing an audio frequency transformation based on the relative velocity to add a Doppler effect to the audio information at the virtual listening point.

According to such method, with respect to the object having the video/audio information constituting the scene that is replayed on the screen in the video/audio format such as MPEG 4, for example, the Doppler effect can be added to the audio information at the virtual listening point such that, for example, the frequency of the sound is increased if the object approaches the virtual listening point or the frequency of the sound is decreased if the object leaves the virtual listening point. Therefore, the audio environment with the strong appeal/reality, which enables the listener to feel that such listener just enters into the video (the virtual listening point), can be produced.

Also, according to at least one embodiment, the relative velocity calculating step calculates the relative velocity between the virtual listening point and the object by calculating velocity information of the object based on position information of the object before and after a predetermined time has lapsed.

According to such method, the Doppler effect is added to the audio information at the virtual listening point by calculating the velocity information of the object based on the position information of the object before and after the predetermined time has lapsed and then calculating the relative velocity between the virtual listening point and the object. Therefore, the Doppler effect caused by the movement of the object can be calculated/processed easily by using the coded position information of the object. As a result, the audio environment with the appeal/reality, which enables the listener to grasp such a situation that the object in the screen is moving from the virtual listening point by the audio, can be produced.

Also, according to at least one embodiment, the relative velocity calculating step calculates the relative velocity by extracting velocity information of the object and then comparing the position information and the velocity information of the object and position information of the virtual listening point.

According to such method, the relative velocity is calculated by extracting velocity information of the object and then comparing the position information and the velocity information of the object and position information of the virtual listening point. Therefore, there is no necessity to calculate the velocity of the object by the operation, and the burden of the calculating process can be reduced correspondingly, and in addition the processing speed can be improved.

Also, according to at least one embodiment, the relative velocity calculating step calculates the relative velocity between the virtual listening point and the object by calculating velocity information of the virtual listening point based on position information of the virtual listening point before and after a predetermined time has lapsed.

According to such method, the Doppler effect is added to the audio information at the virtual listening point by calculating the velocity information of the virtual listening point based on position information of the virtual listening point before and after the predetermined time has lapsed and then calculating the relative velocity between the virtual listening point and the object. Therefore, the Doppler effect caused by the movement of the virtual listening point can be calculated/processed easily by using the position information of the virtual listening point. As a result, the audio environment with the appeal/reality, which enables the listener to grasp such a situation that the listener himself or herself (positioned at the virtual listening point) is moving by the audio, can be produced.

Also, according to at least one embodiment, the relative velocity calculating step calculates the relative velocity by extracting velocity information of the virtual listening point and then comparing position information and the velocity information of the virtual listening point and the position information of the object.

According to such method, the relative velocity is calculated by extracting velocity information of the virtual listening point and then comparing the position information and the velocity information of the virtual listening point and the position information of the object. Therefore, there is no necessity to calculate the velocity of the virtual listening point by the operation, and the burden of the calculating process can be reduced correspondingly, and in addition the processing speed can be improved.

Also, according to at least one embodiment, an audio information transforming method is applied to a video/audio format in which each scene that is replayed on a screen has video information and audio information, and the scene has velocity information and direction information based on which a background is moved, comprises a virtual listening point setting step of setting a virtual listening point at a position different from a basic listening point that is set as a position at which a listener listens to an audio; a relative velocity calculating step of calculating a relative velocity between the virtual listening point and a background based on the velocity information and the direction information of the background; and an audio frequency transforming step of transforming an audio frequency based on the relative velocity to add a Doppler effect to the audio information at the virtual listening point.

According to such method, with respect to the scene that is replayed on the screen in the video/audio format such as DVD, for example, the Doppler effect is added to the audio information at the virtual listening point in response to the moving speed of the background. Therefore, the audio environment with the strong appeal/reality, which enables the listener to feel that such listener just enters into the video (the virtual listening point) and to grasp such a situation that the background of the screen is moving from the virtual listening point by the audio, can be produced.

Also, according to at least one embodiment, when the audio information including the Doppler effect previously is included in the object, the audio frequency transforming step executes an audio frequency transformation to cancel the Doppler effect included in the audio information of the object, and executes the audio frequency transformation based on the relative velocity to add the Doppler effect to the audio information of the virtual listening point.

According to such method, in the case that the audio information including the Doppler effect previously is included in the object, first such Doppler effect included in the audio information is canceled, and then the Doppler effect is added to the audio information at the virtual listening point. Therefore, even if the Doppler effect is included in the audio information prior to the transformation, the Doppler effect caused when the object in the screen moves from the virtual listening point can be expressed precisely.

Also, according to at least one embodiment, audio information transformation at a time of final image unit is executed by adding the Doppler effect to the audio information at the virtual listening point by using a formula by which the audio frequency transformation of the audio information at the virtual listening point prior to the final image by one image unit is executed.

According to such method, in the case that the position information of the succeeding screen cannot be obtained at the time of the final image of the title that is now being replayed, for example, the audio frequency of the object, which is heard at the virtual listening point, can be calculated by using the formula of the audio frequency transformation that is obtained in audio frequency transformation processing in the preceding image of the final image. Therefore, such a possibility can be eliminated that the audio frequency transformation cannot be executed in the final image of the title, or the like because of lack of information.

Also, according to at least one embodiment, the video/audio format includes reduced scale information of the screen every scene.

According to such method, when the reduced scale of the screen is changed by zoom-in, zoom-out, or the like of the replayed screen, the audio information transformation set forth in at least one embodiment can be executed precisely.

A video/audio format at least one embodiment includes velocity information of the object, or velocity information and direction information of the scene, or reduced scale information of the screen every scene, which are employed in the audio information transforming method set forth in at least one other embodiment. Also, at least one embodiment encodes velocity information of the object, or velocity information and direction information of the scene, or reduced scale information of the screen every scene, which are employed in the audio information transforming method set forth in at least one other embodiment.

According to such encoder, the velocity information of the object, the velocity information and the direction information of the scene, and the reduced scale information of the screen every scene are encoded, and then these information are included in the video/audio format. Therefore, the audio information transformation set forth in at least one other embodiment can be implemented.

In order to attain the above object, an audio information transforming program in at least one other embodiment causes a computer to execute, a procedure of setting a virtual listening point at a position different from a basic listening point that is set as a position at which a listener listens to an audio; a procedure of calculating a relative velocity between the virtual listening point and the object; and a procedure of executing an audio frequency transformation based on the relative velocity to add a Doppler effect to the audio information at the virtual listening point.

According to such program, with respect to the object having the video/audio information constituting the scene that is replayed on the screen in the video/audio format such as MPEG 4, for example, the Doppler effect can be added to the audio information at the virtual listening point such that, for example, the frequency of the sound is increased if the object approaches the virtual listening point or the frequency of the sound is decreased if the object leaves the virtual listening point. Therefore, if the recording medium (the memory such as ROM, or the like) in which this program is recorded is employed, the video/audio player (DVD player, LD player, game, MPEG player, system in the movie theater, etc.) that can produce the audio environment with the appeal/reality, which permits the listener to feel that such listener just enters into the video (the virtual listening point), can be implemented.

In the audio information transforming according to at least one embodiment, the procedure of calculating the relative velocity includes a procedure of calculating velocity information of the object based on position information of the object before and after a predetermined time has lapsed.

According to such program, since the procedure of calculating the relative velocity calculates the velocity information of the object based on position information of the object before and after the predetermined time has lapsed, the Doppler effect caused by the movement of the object can be calculated/processed easily by using the coded position information of the object. Therefore, if the recording medium (the memory such as ROM, or the like) in which this program is recorded is employed, the video/audio player (DVD player, LD player, game, MPEG player, system in the movie theater, etc.) that can produce the audio environment with the appeal/reality, which enables the listener to grasp such a situation that the object in the screen is moving from the virtual listening point by the audio, can be implemented.

In the audio information transforming program according to at least one embodiment, the procedure of calculating the relative velocity includes a procedure of extracting velocity information of the object and then comparing the position information and the velocity information of the object and position information of the virtual listening point.

According to such program, since the procedure of calculating the relative velocity extracts velocity information of the object and then compares the position information and the velocity information of the object and the position information of the virtual listening point, there is no necessity to calculate the velocity of the object by the operation, and the burden of the calculating process can be reduced correspondingly, and in addition the processing speed can be improved. Therefore, if the recording medium (the memory such as ROM, or the like) in which this program is recorded is employed, the video/audio player (DVD player, LD player, game, MPEG player, system in the movie theater, etc.) that can produce the audio environment with the appeal/reality, which enables the listener to grasp such a situation that the object in the screen is moving from the virtual listening point by the audio, can be implemented.

In the audio information transforming program according to at least one embodiment, the procedure of calculating the relative velocity includes a procedure of calculating velocity information of the virtual listening point based on position information of the virtual listening point before and after a predetermined time has lapsed.

According to such program, since the velocity information of the virtual listening point is calculated based on the position information of the virtual listening point before and after the predetermined time has lapsed, the Doppler effect caused by the movement of the virtual listening point can be calculated/processed easily by using the position information of the virtual listening point. Therefore, if the recording medium (the memory such as ROM, or the like) in which this program is recorded is employed, the video/audio player (DVD player, LD player, game, MPEG player, system in the movie theater, etc.) that can produce the audio environment with the appeal/reality, which enables the listener to grasp such a situation that the listener himself or herself (positioned at the virtual listening point) is moving by the audio, can be implemented.

According to at least one embodiment, the procedure of calculating the relative velocity includes a procedure of calculating the relative velocity by extracting velocity information of the virtual listening point and then comparing position information and the velocity information of the virtual listening point and the position information of the object.

According to such program, the relative velocity is calculated by extracting the velocity information of the virtual listening point and then comparing the position information and the velocity information of the virtual listening point and the position information of the object. Therefore, there is no necessity to calculate the velocity of the virtual listening point by the operation, and the burden of the calculating process can be reduced correspondingly, and in addition the processing speed can be improved. As a result, if the recording medium (the memory such as ROM, or the like) in which this program is recorded is employed, the video/audio player (DVD player, LD player, game, MPEG player, system in the movie theater, etc.) that can produce the audio environment with the appeal/reality, which enables the listener to grasp such a situation that the listener himself or herself is moving by the audio, can be implemented.

An audio information transforming program according to at least one embodiment causes a computer to execute, a procedure of setting a virtual listening point at a position different from a basic listening point that is set as a position at which a listener listens to an audio; a procedure of calculating a relative velocity between the virtual listening point and a background according to a velocity and a direction based on which the background of a scene is moved; and a procedure of executing an audio frequency transformation based on the relative velocity to add a Doppler effect to the audio information at the virtual listening point.

According to such program, with respect to the scene that is replayed on the screen in the video/audio format such as DVD, for example, the Doppler effect is added to the audio information at the virtual listening point in response to the moving speed of the background. Therefore, if the recording medium (the memory such as ROM, or the like) in which this program is recorded is employed, the video/audio player (DVD player, LD player, game, MPEG player, system in the movie theater, etc.), which can produce the audio environment with the strong appeal/reality, can be implemented.

In the audio information transforming program according to at least one embodiment, when the audio information including the Doppler effect previously is included in the object, the procedure of executing an audio frequency transformation includes a procedure of executing an audio frequency transformation to cancel the Doppler effect included in the audio information of the object, and executing the audio frequency transformation based on the relative velocity to add the Doppler effect to the audio information of the virtual listening point.

According to such program, in the case that the audio information including the Doppler effect previously is included in the object, first such Doppler effect included in the audio information is canceled, and then the Doppler effect is added to the audio information at the virtual listening point. Therefore, even if the Doppler effect is included in the audio information prior to the transformation, the Doppler effect caused when the object in the screen moves from the virtual listening point can be expressed precisely. As a result, if the recording medium (the memory such as ROM, or the like) in which this program is recorded is employed, the video/audio player (DVD player, LD player, game, MPEG player, system in the movie theater, etc.), which can produce the audio environment with the strong appeal/reality, can be implemented.

In the audio information transforming according to at least one embodiment, when audio information transformation at a time of final image unit is executed, a procedure of adding the Doppler effect to the audio information at the virtual listening point by using a formula, by which the audio frequency transformation of the audio information at the virtual listening point prior to the final image by one image unit is executed, is included.

According to such program, in the case that the position information of the succeeding screen cannot be obtained at the time of the final image of the title that is now being replayed, for example, the audio frequency of the object, which is heard at the virtual listening point, can be calculated by using the formula of the audio frequency transformation that is obtained in audio frequency transformation processing in the preceding image of the final image. Therefore, such a possibility can be eliminated that the audio frequency transformation cannot be executed in the final image of the title, or the like because of lack of information. As a result, if the recording medium (the memory such as ROM, or the like) in which this program is recorded is employed, the video/audio player (DVD player, LD player, game, MPEG player, system in the movie theater, etc.), which can produce the audio environment with the strong appeal/reality, can be implemented.

In the audio information transforming program according to at least one embodiment, the video/audio format includes reduced scale information of the sceen every scene.

According to such program, when the reduced scale of the screen is changed by zoom-in, zoom-out, or the like of the replayed screen, the audio information transformation can be executed precisely. Therefore, if the recording medium (the memory such as ROM, or the like) in which this program is recorded is employed, the video/audio player (DVD player, LD player, game, MPEG player, system in the movie theater, etc.), which can produce the audio environment with the strong appeal/reality, can be implemented.

In order to attain the above object, an audio information transforming device according to at least one embodiment for a video/audio format in which a screen includes a plurality of objects and each object has video informaion, position information, and audio information, comprises a virtual listening point setting section for setting a virtual listening point at a position different from a basic listening point that is set as a position at which a listener listens to an audio; a relative velocity calculatin section for calculating a relative velocity between the virtual listening point and the object; and an audio frequency transforming section for executing an audio frequency transformation based on the relative velocity to add a Doppler effect to the audio information at the virtual listening point.

According to such device, with respect to the object having the video/audio information constituting the scene that is replayed on the screen in the video/audio format such as MPEG 4, for example, the Doppler effect can be added to the audio information at the virtual listening point such that, for example, the frequency of the sound is increased if the object approaches the virtual listening point or the frequency of the sound is decreased if the object leaves the virtual listening point. Therefore, if this audio information transforming device is employed, the audio environment with the strong appeal/reality, which enables the listener to feel that such listener just enters into the video (the virtual listening point), can be produced.

In the audio information transforming device according to at least one embodiment, the relative velocity calculating section calculates the relative velocity by comparing position information of the virtual listening point and the position information of the object and the position information of the virtual listening point and the position information of the object after a predetermined time has lapsed.

According to such device, the audio environment with the appeal/reality, which enables the listener to feel that such listener just enters into the video (the virtual listening point) and to grasp such a situation that the object in the screen is moving from the virtual listening point by the audio or to grasp such a situation that the listener himself or herself is moving by the audio, can be produced.

In the audio information transforming according to at least one embodiment, the relative velocity calculating section calculates the relative velocity by comparing the position information and velocity information of the object and the position information of the object and the position informaion of the virtual listening point.

According to such device, the audio environment with the appeal/reality, which enables the listener to feel that such listener just enters into the video (the virtual listening point) and to grasp such a situation that the object in the screen is moving from the virtual listening point by the audio, can be produced.

In the audio information transforming device according to at least one embodiment, the relative velocity calculating section calculates the relative velocity by comparing the position information of the object and the position information and velocity information of the virtual listening point.

According to such device, the audio environment with the appeal/reality, which enables the listener to feel that such listener just enters into the video (the virtual listening point) and to grasp such a situation that the listener himself or herself (positioned at the virtual listening point) is moving by the audio, can be produced.

An audio information transforming device according to at least one embodiment for a video/audio format in which each scene that is replayed on a screen has video information and audio information, and the scene has velocity information and direction information based on which a background is moved, comprises a virtual listening point setting section for setting a virtual listening point at a position different from a basic listening point that is set as a position at which a listener listens to an audio; a relative velocity calculating section for calculating a relative velocity between the virtual listening point and the background based on the velocity information and the direction information of the background; and an audio frequency transforming section for executing an audio frequency transformation based on the relative velocity to add a Doppler effect to the audio information at the virtual listening point.

According to such device, with respect to the scene that is replayed on the screen in the video/audio format such as DVD, for example, the Doppler effect is added to the audio information at the virtual listening point in response to the moving speed of the background. Therefore, the audio environment with the appeal/reality, which enables the listener to feel that such listener just enters into the video (the virtual listening point) and to grasp such a situation that the background of the screen is moving from the virtual listening point by the audio, can be produced.

BRIEF DESCRIPTION OF THE DRAWINGS

FIG. 14 is a view explaining the audio information transforming method according to a tenth embodiment of the present invention, and a view showing an example of a video/audio format.

Figure 1:
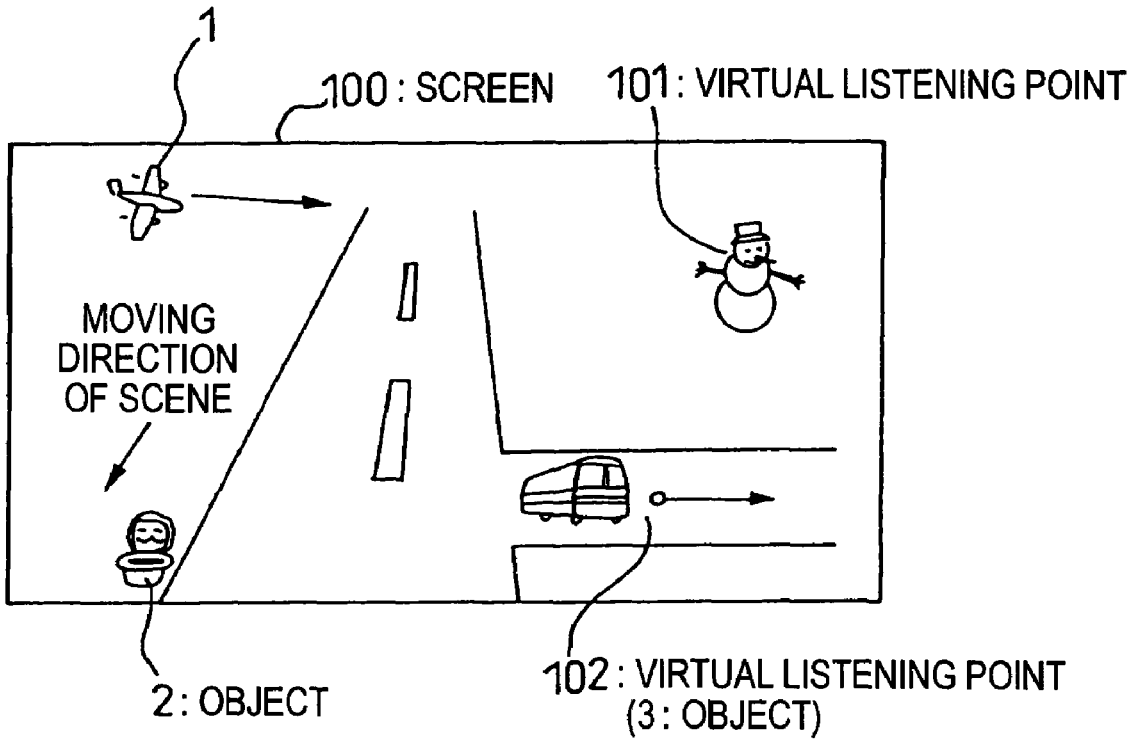
FIG. 1 is a view explaining an audio information transforming method according to a first embodiment of the present invention.

In the drawings, the reference numeral 1, 2, 3, each refers to an object; 100, 801 to a screen; 101, 102, 701, 1002 to a virtual listening point; 1001 to a basic listening point; 1201 to a time axis; 1500 to an audio information transforming device; 1510 to a video/audio format; 1520 to a virtual listening point setting section; 1530 relative velocity calculating section; and 1540 to an audio frequency transforming section.

DETAILED DESCRIPTION OF THE PREFERRED EMBODIMENTS

Embodiments of the present invention will be explained in detail with reference to the drawings hereinafter.

First Embodiment

FIG. 1 is a view explaining a first embodiment of the present invention.

In FIG. 1, a virtual listening point 101 is decided in a screen 100. Also, assume that a video object 1 having audio information is moving from the left to the right of the screen 100. Then, if coordinates of the virtual listening point 101 are set to (x1, y1, z1), a current position of the object 1 is set to P1 (xa, ya, za) in FIG. 2, and a position after a time t has lapsed is set to P2 (xb, yb, zb) in FIG. 2, a vector between them is given by Equation (1).

[Formula 1]

$$\overrightarrow{P1P2}=(xb-xa,\ yb-ya,\ zb-za) \tag{1}$$

A velocity of the object 1 is calculated to take account of unit of time. In this case, if a velocity of the object 1 is set to V1, this velocity is given by Equation (2).

[Formula 2]

$$V1=k(xb-xa,\ yb-ya,\ zb-za) \tag{2}$$

where k is a constant.

Figure 2:
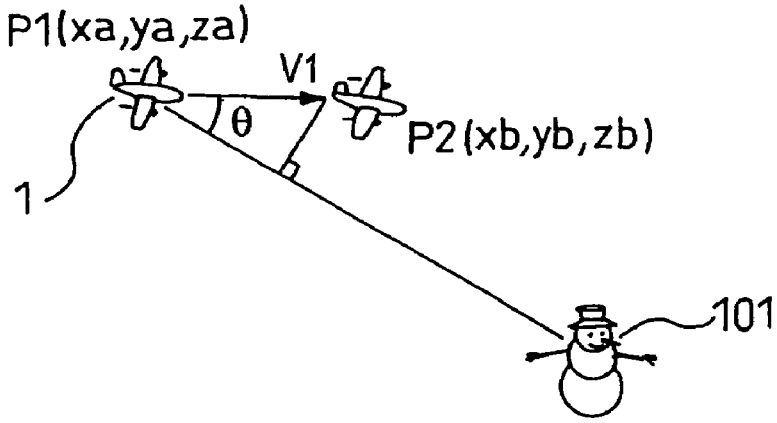
FIG. 2 is a view explaining the audio information transforming method according to the first embodiment of the present invention.

Then, a cos θ is calculated by using an angle θ between a vector directed from the position P1 to the virtual listening point 101 and a vector directed from the position P1 to the position P2, as shown in FIG. 2. Then, a component of the velocity V1 of the object 1 in the direction directed from the position P1 to the virtual listening point 101 can be represented by Equation (3).

[Formula 3]

$$V1'=V1\cos\theta \tag{3}$$

Here, assume that a velocity of the sound is v, an audio frequency of a sound source is f, and an audio frequency of the sound heard at the virtual listening point 101 is f1, this audio frequency f1 can be represented by Equation (4).

[Formula 4]

$$f1=\frac{v}{v-V1'}f \tag{4}$$

As can be seen from Equation (4), even though the virtual listening point 101 is set at any place, the listener can enjoy the audio with stronger reality by changing the audio frequency of the audio information that is heard at the virtual listening point 101.

As described above, in the present embodiment, the virtual listening point 101 is decided at a position different from the basic listening point that is set as a position at which the listener listens to the audio, then a relative velocity between the virtual listening point 101 and the object 1 is calculated based on position information of the virtual listening point 101 and position information of the object 1, and then the audio frequency at the virtual listening point 101 is changed according to the calculated relative velocity. Therefore, the sound field with the reality can be generated by moving freely the virtual listening point 101 at which the listener can exist virtually.

Second Embodiment

Figure 3:
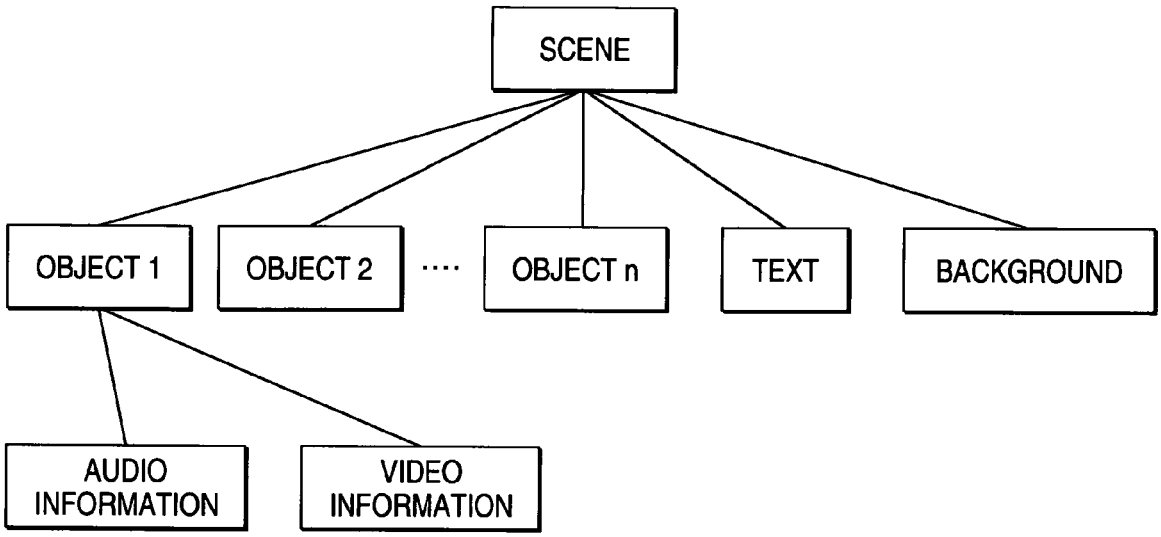
FIG. 3 is a view explaining an audio information transforming method according to a second embodiment of the present invention, and an image view of a scene describing format.

FIG. 3 is a view explaining a second embodiment of the present invention.

In the above first embodiment, the velocity of the object 1 is calculated based on the coordinate information, and the audio frequency of the audio that is heard at the virtual listening point 101 is changed on the basis of the information. However, if the object 1 includes velocity information previously in time unit, such calculation is not needed. In the present embodiment, if the video/audio format has the velocity information that is encoded previously by an encoder, or the like, such velocity information is extracted and then the audio frequency of the audio that is heard at the virtual listening point is calculated based on such information.

In the video/audio format described by a format shown in FIG. 3, velocity information of the objects 1, 2, . . . n are obtained. Like the first embodiment, if the velocity of the object 1 is set to V1, a velocity component V1' directed from the object 1 to the virtual listening point 101 can be represented, as shown in Equation (5), by using the angle θ shown in FIG. 2.

[Formula 5]

$$V1'=V1\cos\theta \tag{5}$$

Here, assume that the velocity of the sound is v, the audio frequency of the sound from the sound source is f, and the audio frequency of the sound heard at the virtual listening point 101 is f1, this audio frequency f1 can be represented by Equation (6).

[Formula 6]

$$f1=\frac{v}{v-V1'}f \tag{6}$$

In Equation (6), if the audio frequency of the audio information that is heard at the virtual listening point 101 is changed, the listener can enjoy the audio with the reality even though the virtual listening point 101 is set at any place.

Figure 4:
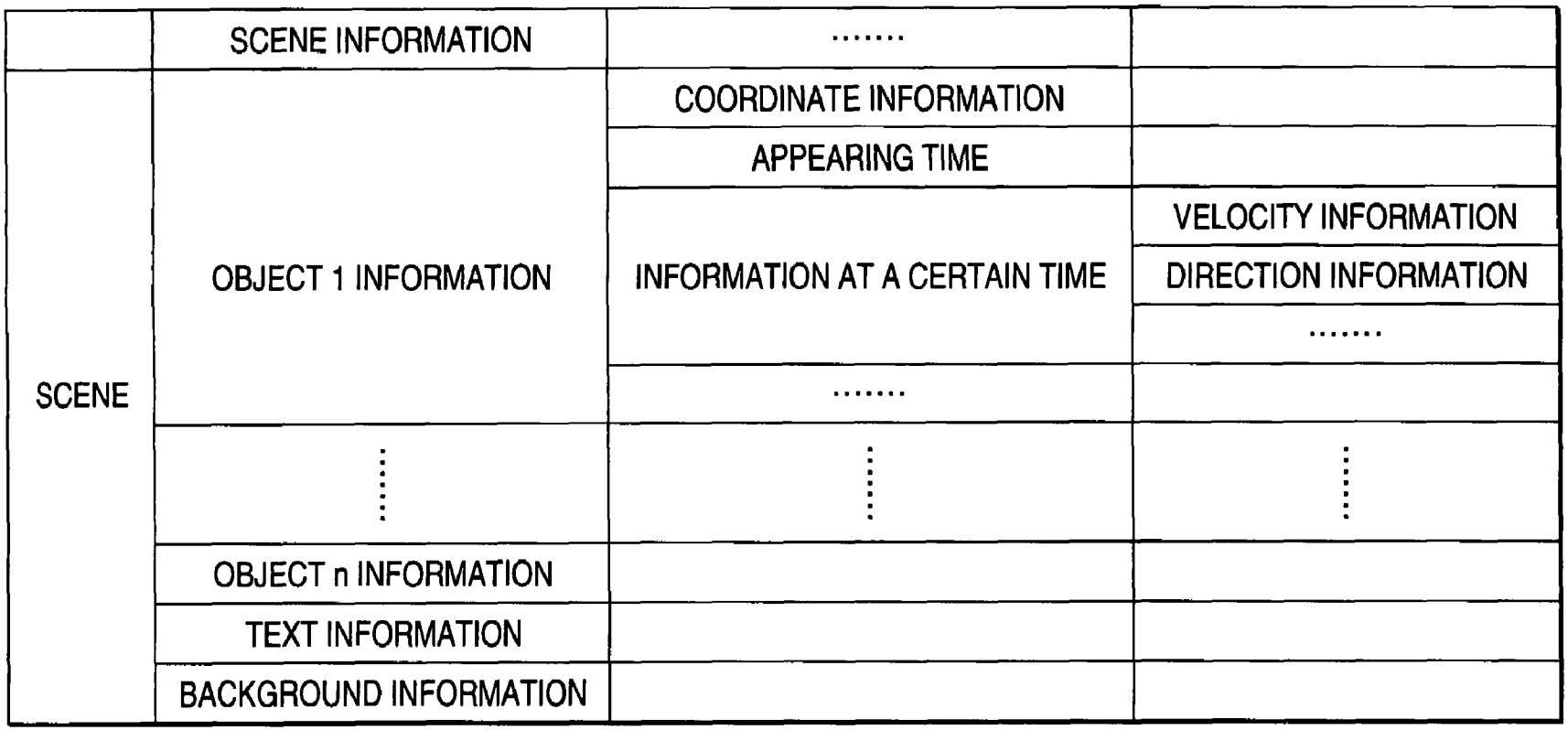
FIG. 4 is a view explaining the audio information transforming method according to the second embodiment of the present invention, and a view showing an example of a video/audio format.

Meanwhile, in order to implement the present embodiment, the velocity information and the direction information of the object 1 must be described in the object information. For example, as shown in FIG. 4, the velocity information and the direction information are included in the information at a certain time out of the object 1 information, generation of the audio with regard to the Doppler effect can be realized by using these information.

In this fashion, according to the present embodiment, the virtual listening point 101 is decided at a position different from the basic position at which the listener listens to the sound of the object 1, then an approaching or leaving velocity of the object 1 that is observed at the virtual listening point 101 is calculated based on the velocity information and the moving direction information of the object 1 and the position information of the virtual listening point 101, and then the audio frequency of the audio that is heard at the virtual listening point 101 is changed according to the calculated velocity. Therefore, it is possible to provide the stronger appeal and reality than the first embodiment to the audio that is heard at the virtual listening point 101. According to the obtained relative velocity, the audio frequency transforming section changes the audio frequency information of the virtual listening point 101.

Third Embodiment

Figure 5:
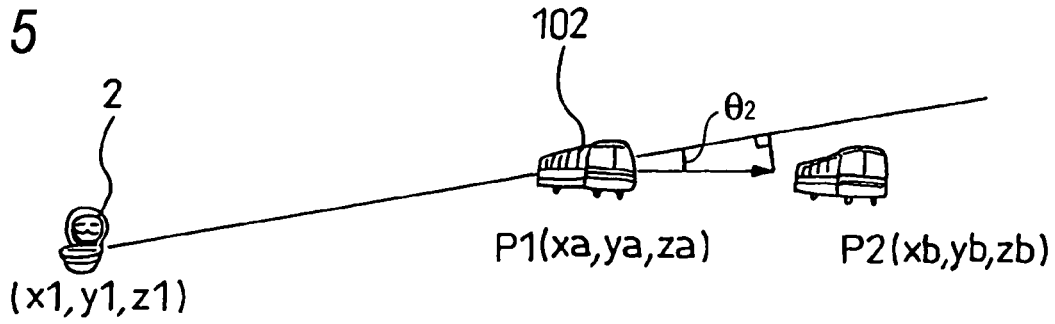
FIG. 5 is a view explaining an audio information transforming method according to a third embodiment of the present invention.

FIG. 5 is a view explaining a third embodiment of the present invention.

In FIG. 5, assume that a virtual listening point 102 is moved rightward in the screen. Also, assume that a video object 2 having the audio information is not moved. Then, if coordinates of the object 2 are set to (x1, y1, z1) shown in FIG. 5, a current position of the virtual listening point 102 is set to P1 (xa, ya, za) in FIG. 5, and a position after the time t has lapsed is set to P2 (xb, yb, zb), a vector between them can be represented by Equation (7).

[Formula 7]

$$\overrightarrow{P1P2}=(xb-xa,\ yb-ya,\ zb-za) \tag{7}$$

A velocity of the virtual listening point 102 is calculated with regard to unit of time. If the velocity of the virtual listening point 102 is set to V1, this velocity V1 can be represented by Equation (8).

[Formula 8]

$$V1=k(xb-xa,\ yb-ya,\ zb-za) \tag{8}$$

where k is a constant.

Then, the cos θ is calculated by using the angle θ between a vector directed from the object 2 to the position P1 and a vector directed from the position P1 to the position P2, as shown in FIG. 5. Then, a component V1' of the velocity V1 of the virtual listening point 102 in the direction directed from the object 2 to the position P1 can be represented by Equation (9).

[Formula 9]

$$V1'=V1\cos\theta \tag{9}$$

Here, assume that the velocity of the sound is v, the audio frequency of the sound emitted from the sound source is f, and an audio frequency of the sound heard at the virtual listening point 102 is f1, this audio frequency f1 can be represented by Equation (10).

[Formula 10]

$$f1=\frac{v-V1'}{v}f \tag{10}$$

As a result, even though the virtual listening point 102 is set at any place, the listener can enjoy the is audio with the stronger reality by changing the audio frequency of the audio information that is heard at the virtual listening point 102.

As described above, according to the present embodiment, the virtual listening point 102 is decided at the position different from the basic listening point at which the listener listens to the audio of the object 2, then a velocity of the virtual listening point 102, which is observed from the object 2, is calculated based on the position information of the object 2 and the position information of the virtual listening point 102 when such virtual listening point 102 is moved, and then the audio frequency of the audio that is heard at the virtual listening point 102 is changed according to the calculated velocity. Therefore, even if the virtual listening point 102 is moved to any place, the sound field with the reality can be generated.

Fourth Embodiment

Figure 6:
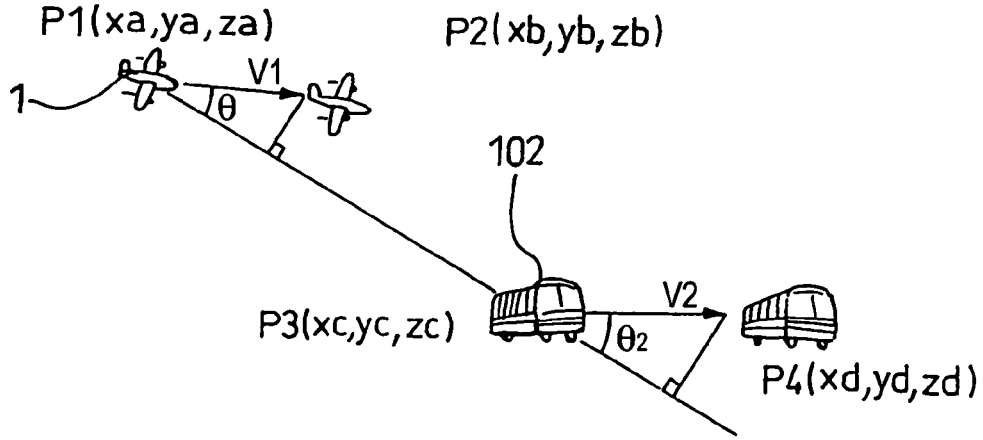
FIG. 6 is a view explaining an audio information transforming method according to a fourth embodiment of the present invention.

FIG. 6 is a view explaining a fourth embodiment of the present invention. As shown above FIG. 5, assume that the virtual listening point 102 is moved rightward in the screen. Also, assume that the video object 2 having the audio information is not moved. Then, assume that coordinates of the object 2 are set to (x1, y1, z1) shown in FIG. 5, the virtual listening point 102 has the velocity information (including also the direction information), and the velocity is set to V1.

Then, the cos θ is calculated by using an angle θ between a vector directed from the object 2 to the position P1 and a vector directed from the position P1 to the position P2, as shown in FIG. 5. Then, a component of the velocity V1 of the virtual listening point 102 in the direction directed from the object 2 to the position P1 can be represented by Equation (11).

[Formula 11]

$$V1'=V1\cos\theta \tag{11}$$

Here, assume that the velocity of the sound is v, the audio frequency of the sound emitted from the sound source is f, and the audio frequency of the sound heard at the virtual listening point 102 is f1, this audio frequency f1 can be represented by Equation (12).

[Formula 12]

$$f1=\frac{v-V1'}{v} \tag{12}$$

As a result, even though the virtual listening point 102 is set at any place, the listener can enjoy the audio with the reality by changing the audio frequency of the audio information that is heard at the virtual listening point 102.

In this manner, according to the present embodiment, the virtual listening point 102 is decided at the position different from the basic listening point at which the listener listens to the audio of the object 2, then the velocity and the moving direction are decided when such virtual listening point 102 is moved, then an approaching or leaving velocity of the object 2 that is observed at the virtual listening point 102 is calculated, and then the audio frequency of the audio that is heard at the virtual listening point 102 is changed according to the calculated velocity. Therefore, even through the virtual listening point 102 is moved to any place, the sound field with the reality can be generated.

Fifth Embodiment

In the present embodiment, when both the object 1 having the video information and the audio information and the virtual listening point 102 are moved, the audio frequency of the audio that is heard at the virtual listening point 102 is changed.

Assume that the object 1 having the video information and the audio information, as shown in above FIG. 1, is present. Also, the moving virtual listening point 102 shown in FIG. 5 is decided. Then, if the current position of the object 1 is set to P1 (xa, ya, za) shown in FIG. 6, and a position after the time t has lapsed is set to P2 (xb, yb, zb) shown in FIG. 6, a vector between them can be represented by Equation (13).

[Formula 13]

$$\overrightarrow{P1P2}=(xb-xa,\ yb-ya,\ zb-za) \tag{13}$$

A velocity of the object 1 is calculated to take account of unit of time. If the velocity of the object 1 is assumed as V1, this velocity V1 can be represented by Equation (14).

[Formula 14]

$$V1=k(xb-xa,\ yb-ya,\ zb-za) \tag{14}$$

where k is a constant.

Then, the cos θ is calculated by using an angle θ between a vector directed from the position P1 to the virtual listening point 102 and a vector directed from the position P1 to the position P2, as shown in FIG. 6. Then, a component of the velocity V1 of the object 1 in the direction directed from the position P1 to the position P2 can be represented by Equation (15).

[Formula 15]

$$V1'=V1\cos\theta \tag{15}$$

Similarly, if a current position of the virtual listening point 102 is set to P3 (xc, yc, zc) shown in FIG. 6 and a position after the time t has lapsed is P4 (xd, yd, zd) shown in FIG. 6, a vector between them can be represented by Equation (16).

[Formula 16]

$$\overrightarrow{P3P4}=(xd-xc,\ yd-yc,\ zd-zc) \tag{16}$$

The velocity of the virtual listening point 102 is calculated with regard to unit of time. If the velocity of the virtual listening point 102 is set to V2, this velocity V2 can be represented by Equation (17).

[Formula 17]

$$V2=k'(xd-xc,\ yd-yc,\ zd-zc) \tag{17}$$

where k' is a constant.

Then, a cos θ2 is calculated by using an angle θ2 between a vector directed from the position P1 to the position P3 and a vector directed from the position P3 to the position P4, as shown in FIG. 6. Then, a component of the velocity V2 in the direction directed from the position P1 to the position P3 can be represented by Equation (18).

[Formula 18]

$$V2'=V2\cos\theta 2 \tag{18}$$

Here, assume that the velocity of the sound is v, the audio frequency of the sound source is f, and an audio frequency of the audio heard at the virtual listening point 102 is f1, this audio frequency f1 can be represented by Equation (19).

[Formula 19]

$$f1=\frac{v-V2'}{v-V1'}f \tag{19}$$

Even if the virtual listening point 102 is set at any place, the listener can enjoy the audio with the stronger reality by changing the audio frequency of the audio information, which is heard at the virtual listening is point 102, into f1.

In this manner, according to the present embodiment, when both the object 2 and the virtual listening point 102 are moved, the velocity of the object 2, which is observed from the virtual listening point 102, and the velocity of the virtual listening point 102, which is observed from the object 2, are calculated based on the position or velocity information and the moving direction of the object 2 and the position or velocity information and the moving direction of the virtual listening point 102, and then the audio frequency of the audio that is heard at the virtual listening point 102 is changed according to the calculated velocities. Therefore, even if the virtual listening point 102 is moved to any place, the sound field with the reality can be generated.

Sixth Embodiment

Figure 7:
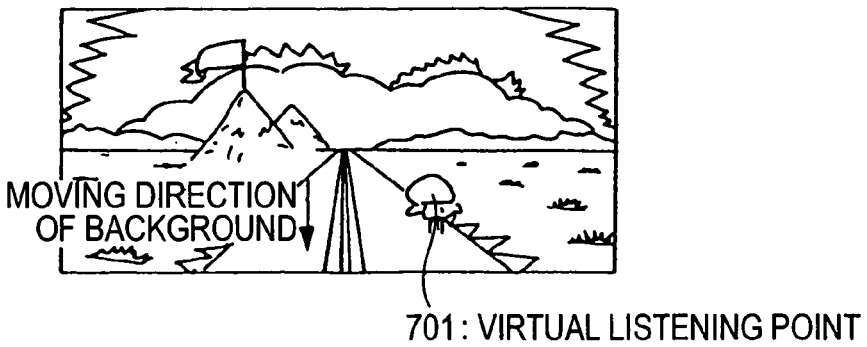
FIG. 7 is a view explaining an audio information transforming method according to a sixth embodiment of the present invention.

FIG. 7 is a view explaining a sixth embodiment of the present invention.

Figure 8:
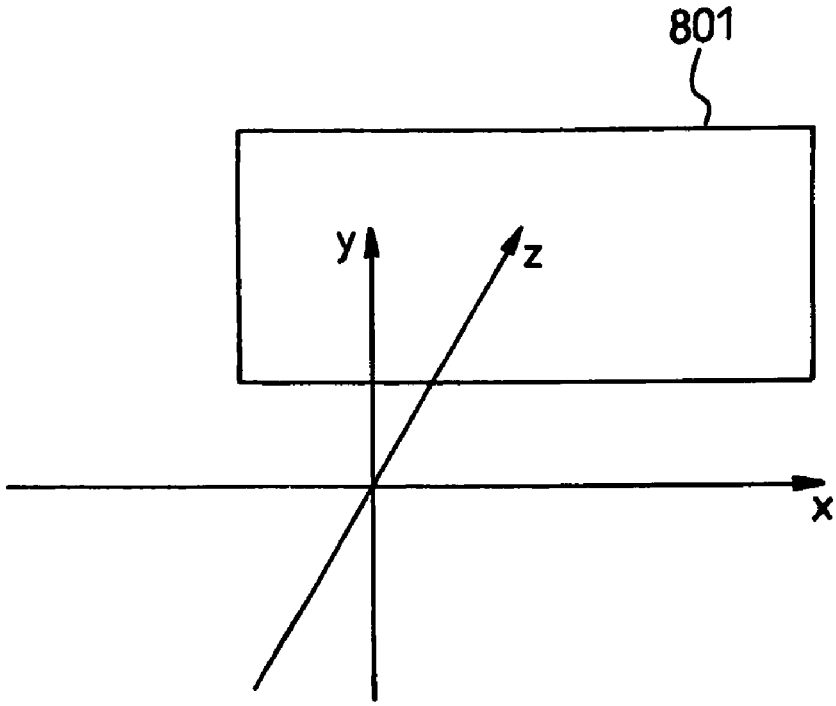
FIG. 8 is a view explaining the audio information transforming method according to the sixth embodiment of the present invention.
Figure 9:
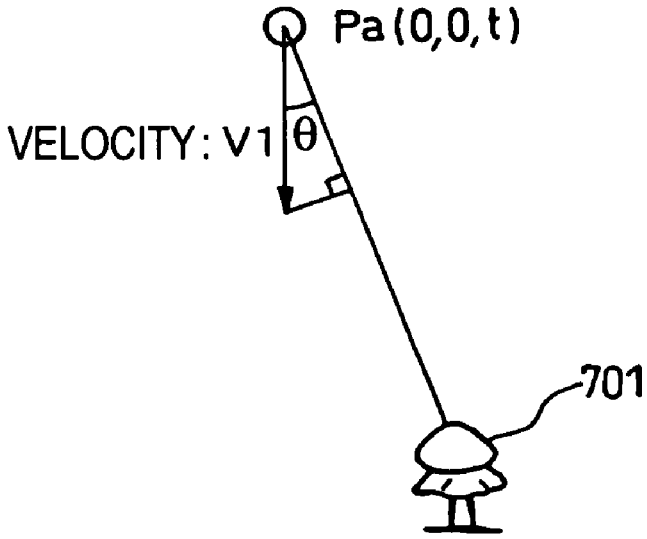
FIG. 9 is a view explaining the audio information transforming method according to the sixth embodiment of the present invention.

As shown in FIG. 7, a virtual listening point 701 is decided. Assume that background data has the audio information and the background is moved, and the video/audio format has the velocity information or the position information. Here, assume that x-y-z axes of a screen 801 are set, as shown in FIG. 8, and the background is regarded as an object that is positioned at (x,y,z)=(0,0,t). Where t is a constant. Accordingly, the audio frequency of the audio that is heard from the virtual listening point 701 is produced by executing the process in the second embodiment. If the background is regarded as the object positioned at a center Pa (0,0,t) and a velocity of the background is set to V1, a velocity component V1' in the direction from the center Pa to the virtual listening point 701 can be represented by Equation (20) by using an angle θ shown in FIG. 9.

[Formula 20]

$$V1'=V1\cos\theta \tag{20}$$

Here, assume that the velocity of the sound is v, the audio frequency of the sound emitted from the sound source is f, and the audio frequency of the sound heard at the virtual listening point 701 is f1, this audio frequency f1 can be represented by Equation (21).

[Formula 21]

$$f1=\frac{v}{v-V1'}f \tag{21}$$

As a result, even though the virtual listening point 701 is set at any place, the listener can enjoy the audio with the stronger reality by changing the audio frequency of the audio information that is heard at the virtual listening point 701.

Figure 10:
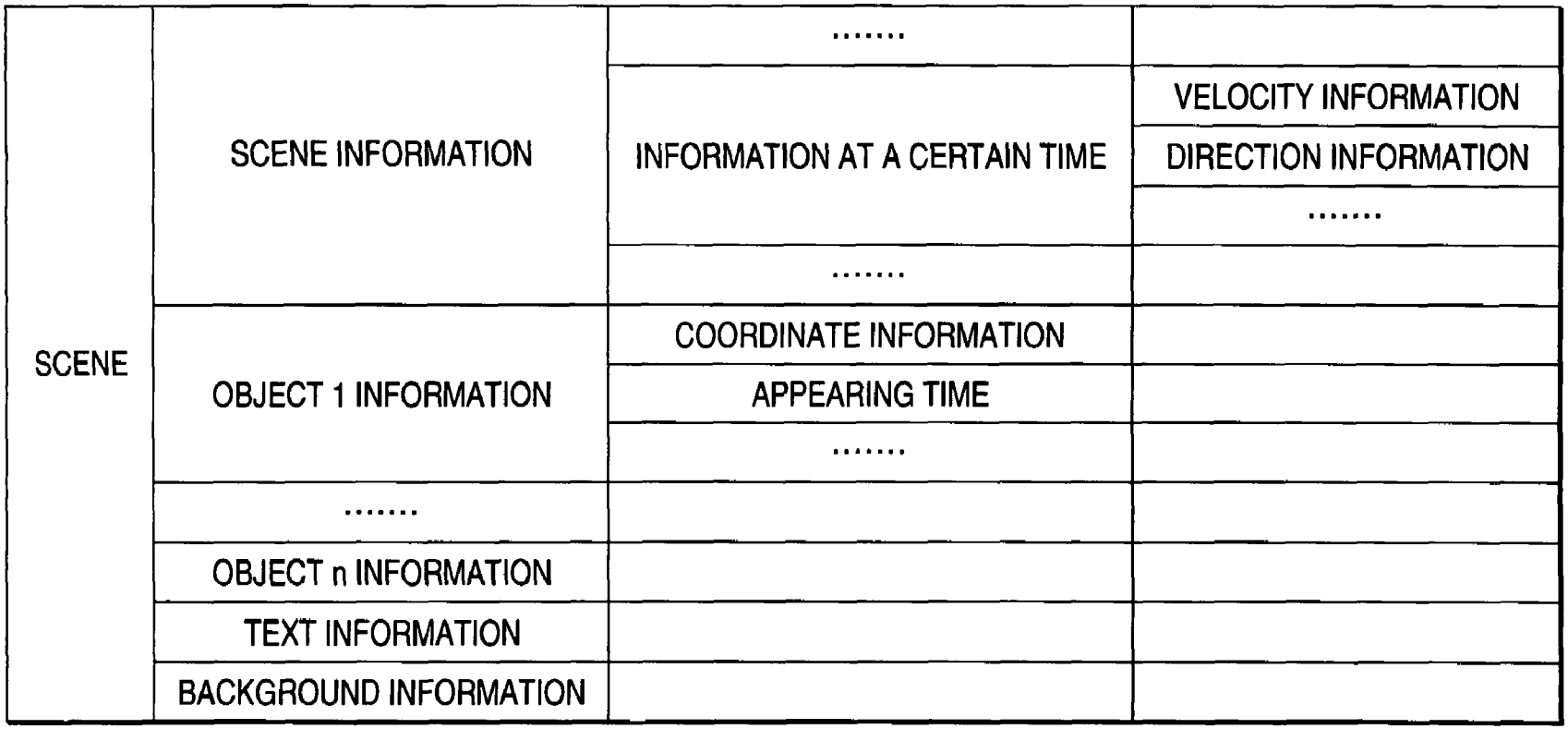
FIG. 10 is a view explaining the audio information transforming method according to the sixth embodiment of the present invention, and a view showing an example of a video/audio format.

In order to implement the present embodiment, the velocity information and the direction information of the scene, which were encoded previously by an encoder, or the like, must be described in the scene information. For example, as shown in FIG. 10, since the velocity information and the direction information are included in the information at a certain time within the scene information, generation of the audio can be realized to take account of the Doppler effect.

In this manner, according to the present embodiment, the virtual listening point 701 is decided in the screen on which the video information is projected, and then the audio frequency of the audio that is heard at the virtual listening point 701 is changed based on the moving direction and the velocity of the scene with regard to the velocity of the background (regarded as the object), which is observed at the virtual listening point 701, and the moving velocity of the scene. Therefore, even through the virtual listening point 701 is moved to any place, the sound field with the reality can be generated.

Seventh Embodiment

In the present embodiment, the virtual listening point 102 shown in above FIG. 1 is used as another object. In the following, this virtual listening point 102 is assumed as an object 3. The position information or velocity information and the direction information of the object 1 and the object 3 are obtained from the video information and the audio information, and then a velocity component in the direction directed from the object 1 to the object 3 is calculated. Assume that a velocity component of the object 1 in the direction directed from the object 1 to the object 3 is V1', a velocity component of the object 3 in the direction directed from the object 1 to the object 3 is V2', the velocity of the sound is v, the audio frequency of the sound of the sound source is f, and the audio frequency of the sound that is heard at the virtual listening point 102 is f1. Equation (22) is derived by applying these matters into the equation indicating the Doppler effect.

[Formula 22]

$$f1=\frac{v-V2'}{v-V1'}f \tag{22}$$

Even if the virtual listening point 102 is set at any place, the listener can enjoy the audio with the stronger reality by changing the audio frequency of the audio information, which is heard from the object 3, into f1.

In this way, according to the present embodiment, one certain object 3 is set at the virtual listening point 102, and then the audio frequency of the audio that is heard at the set virtual listening point 102 is changed. Therefore, even if the virtual listening point 102 is moved to any place, the sound field with the reality can be generated.

Eighth Embodiment

In some cases, it is difficult to get the audio, from which the Doppler effect can be disregarded, when the video information and the audio information are obtained at the time of actual imaging. Also, in many cases, the Doppler effect has already been considered in the audio replayed by the current video/audio player such as the DVD player, the MPEG 4 player, etc. In the situation that the virtual listening point is changed at all places in such sound field, even if the virtual listening point is changed at any place, the present embodiment makes it possible to get the Doppler effect according to such place.

Figure 11:
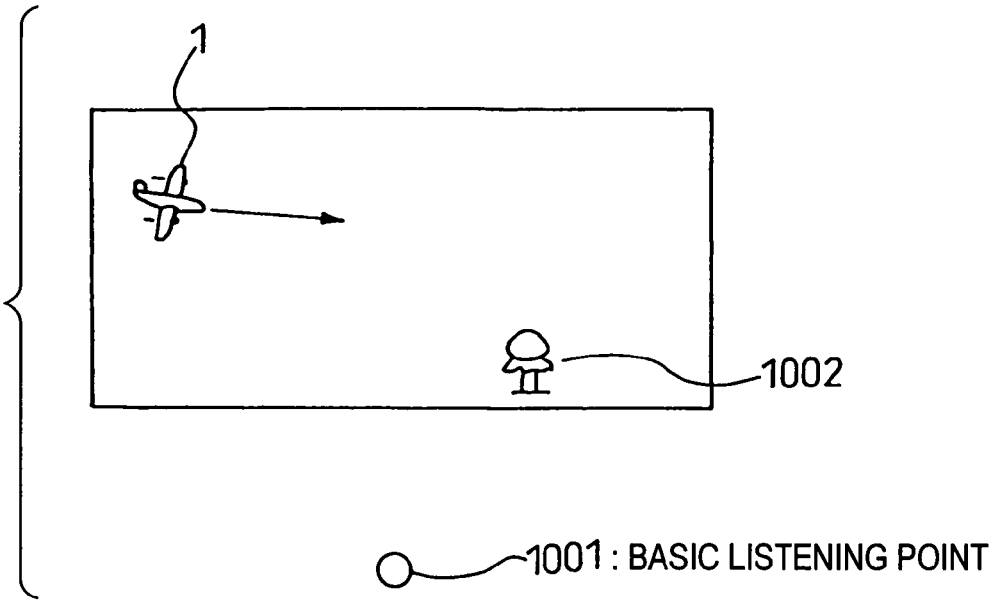
FIG. 11 is a view explaining an audio information transforming method according to an eighth embodiment of the present invention.

The MPEG player is produced under the assumption that basically the listener listens to the audio at a basic listening point 1001 shown in FIG. 11. At that time, assume the object 1 has audio data, sometimes the audio in which the Doppler effect is taken into consideration previously as the sound that is to be heard at the basic listening point 1001 is recorded. Assume that the object 1 is moving at the velocity V1, and the audio frequency of the audio that is heard at the basic listening point 1001 is f1. A velocity component V1' of the object 1 in the direction directed from the object 1 to the basic listening point 1001 is given by Equation (23).

[Formula 23]

$$V1'=V1\cos\theta 1 \tag{23}$$

The audio frequency f1 of the audio that is heard at the basic listening point 1001 can be represented as shown in Equation (24).

[Formula 24]

$$f1=\frac{v}{v-V1'}f \tag{24}$$

Then, if the audio frequency of the audio information of the object 1, in which the Doppler effect is disregarded, is assumed as f, such frequency can be represented by following Equation (25).

[Formula 25]

$$f = \frac{v - V1'}{v} f1 \tag{25}$$

In this manner, if the inverse calculation of the Doppler effect is executed, the audio frequency of the audio information, in which the Doppler effect is not taken into consideration, can be derived from the audio frequency of the audio information, in which the Doppler effect is taken into consideration.

Then, when the audio that is heard at a virtual listening point 1002 is to be generated, the audio frequency of the audio information, which is heard at the virtual listening point 1002, can be derived from the audio frequency of the audio information, in which the Doppler effect is not regarded, according to the formulae shown in the first, second, third, sixth, and seventh embodiments. Here, the audio frequency of the audio information, which is to be heard at the virtual listening point 1002, is derived under the assumption that the virtual listening point 1002 is not moved.

Figure 12:
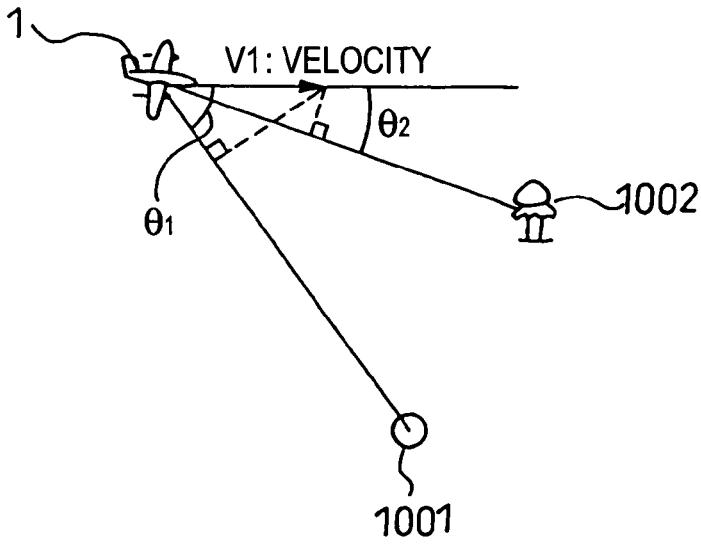
FIG. 12 is a view explaining the audio information transforming method according to the eighth embodiment of the present invention.

In FIG. 12, assume that the audio frequency of the audio information, which is to be heard at the virtual listening-point 1002, is set to f2. If a component of the velocity V1 of the object 1 in the direction directed from the object 1 to the virtual listening point 1002 is set to V2, such component can be represented by Equation (26).

[Formula 26]

$$V2 = V1 \cos \theta 2 \tag{26}$$

Thus, Equation (27) is satisfied.

[Formula 27]

$$f2 = \frac{v}{v - V2} f \tag{27}$$

If following Equation (28) is substituted into Equation (27) based on the object 1 and the basic listening point, Equation (29) can be derived.

[Formula 28]

$$f1 = \frac{v}{v - V1'} f \tag{28}$$

[Formula 29]

$$f2 = \frac{v - V}{v - V2} * \frac{v - V1'}{v} f1 = \frac{v - V1'}{v - V2'} f1$$

Even though the position of the virtual listening point 1002 is changed into any place on the coordinate axes., the listener can enjoy the audio with the stronger reality by adding the appropriate Doppler effect in response to that location.

In this fashion, according to the present embodiment, if there is the audio information to which the Doppler effect obtained when the audio is heard at a certain place has already been added, the audio information to which the Doppler effect is not applied is generated by executing the inverse calculation of the Doppler effect. Then, when the sound field generated by the virtual listening point is to be produced, the Doppler effect is added by using the audio information to which the Doppler effect is not applied. Therefore, when a plurality of sound fields are to be generated from one audio stream, the sound fields with the stronger reality can be generated.

Also, according to the present embodiment, the audio in which the Doppler effect is disregarded can be loaded on audio streams of respective objects, and the sound fields that are heard just in multiple channels can be generated from the audio information in one channel, and also a size of the audio information can be reduced.

Ninth Embodiment

In the present embodiment, velocities of the object and the virtual listening point are calculated when a next image is not present in the final image of the title, for example.

Figure 13:
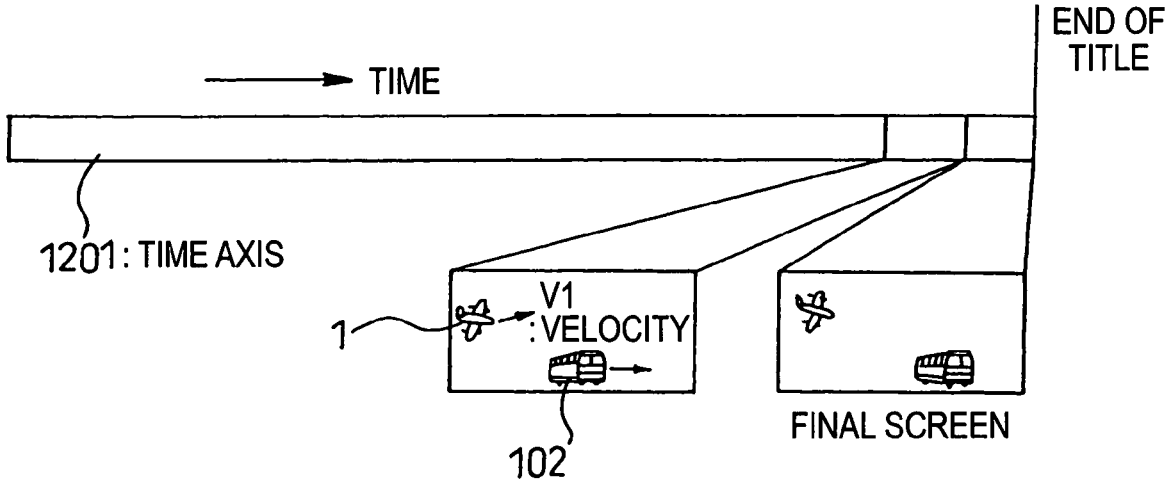
FIG. 13 is a view explaining an audio information transforming method according to a ninth embodiment of the present invention.

When the velocity cannot be calculated from the coordinates of the next image since the next image is not present or since the object or the virtual listening point does not have the velocity information at the timing prior to one image when the screen is exchanged, it is assumed that a time axis is set as shown in FIG. 13 and that the audio frequency of the audio, which is heard at the virtual listening point in the final image unit (the final VOBU, the final cell, or the like), is calculated based on the formula that is applied to the audio frequency of the audio, which is emitted from the object in the final image unit, by using the formula of the audio frequency of the audio, which is heard at the virtual listening point prior to one image unit. The audio frequency of the audio of the object 1, which is heard at the virtual listening point 102 shown in FIG. 13, can be represented by Equation (19) shown in above fifth embodiment.

[Formula 30]

$$f1 = \frac{v - V2'}{v - V1'} f \tag{19}$$

As a result, if the audio frequency of the audio that is emitted from the object 1 in the final image unit is assumed as f', an audio frequency f1' of the object 1, which is heard at the virtual listening point 102 in the final image unit, can be represented by following Equation (30).

[Formula 31]

$$f1' = \frac{v - V2'}{v - V1'} f' \tag{30}$$

In this manner, according to the present embodiment, if the position information of the next screen cannot be obtained from the final screen unit of the title, or the like, the velocity information of the object or the velocity information of the virtual listening point is obtained from the preceding image, and then the audio frequency of the audio of the object, which is heard at the virtual listening point, is calculated. Therefore, even though the virtual listening point is moved to any place, the sound field with the reality can be generated.

Tenth Embodiment

In order to calculate the actual velocity from coordinate data on the screen in plural time units, reduced scale information of the screen must be provided. Since the reduced scale information is different scene by scene, such reduced scale information must be provided every scene. For this reason, in the present embodiment, as shown in FIG. 14, a video/audio format that has reduced scale information, which has been encoded previously by the encoder, or the like, in the scene information is implemented.

In this case, the audio information transforming methods explained in the ninth embodiment to the tenth embodiment are formatted as a program respectively and then are recorded in the recording medium such as a memory in which a decoder for decoding the video/audio format and a decoding program are recorded, a memory in which a program for controlling the decoder is recorded, or the like. As a result, the video/audio player (DVD player, LD player, MPEG player, system in the movie theater, etc.), which can achieve advantages of respective embodiments, can be implemented.

An example of an audio information transforming device for implementing the embodiments mentioned above is explained as follows by referring to FIG. 15.

Figure 15:
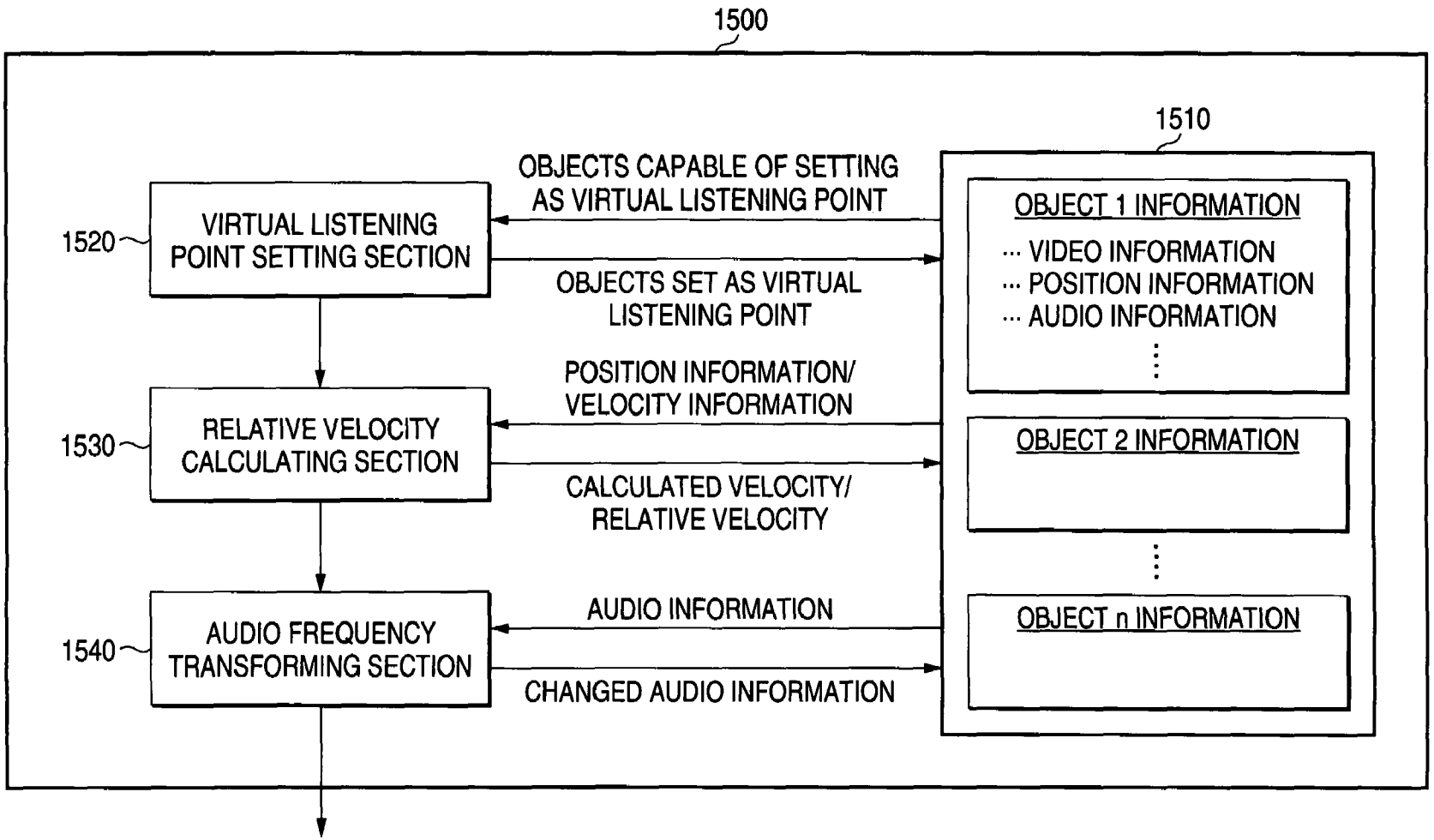
FIG. 15 is a block diagram showing an example of an Audio information transforming System of this invention.

In FIG. 15, an audio information transforming device includes a video/audio format 1510, a virtual listening point setting section 1520, a relative velocity calculating section 1530, and an audio frequency transforming section 1540.

The video/audio format 1510 includes video information, position information, audio information, velocity information, or such in respect to each object on a screen. The virtual listening point setting section 1520 sets the virtual listening point (for example, 101 of FIG. 1). The relative velocity calculating section 1530 calculates the velocity of an object (for example, object 1 of FIG. 1) by comparing a position information of the object 1 at a certain time and a position information of the object 1 after a predetermined time past from the certain time, and then, calculates the relative velocity between the virtual listening point 101 and the object 1, according to position information of the virtual listening point 101 and velocity of the object 1. If the velocity information of the object 1 is included in the video/audio format 1510, the relative velocity calculating section 1530 extracts the velocity information of the object 1 from the video/audio format 1510 instead of calculating the velocity of object 1.

Then, the audio frequency transforming device 1540 changes the audio information of the virtual listening point 101 based on the obtained relative velocity.

If the virtual listening point setting section 1520 sets the point 102 (moving object 3) of FIG. 1 as a virtual listening point and the object 1 of FIG. 1 is considered as a sound source, the relative velocity calculating section 1530 calculates both the velocities of the virtual listening point 102 and the object 1, or extracts the velocity information of the virtual listening point 102 and the object 1. Then, the relative velocity between the moving object 1 and the moving virtual listening point 102 is calculated by the relative velocity calculating section 1530 based on the obtained velocities. According to the calculated relative velocity, the audio frequency transforming section 1540 changes the audio information of the virtual listening point 102.

If only velocity information of the object 1 is included in the video/audio format 1510, the relative velocity calculating section 1530 calculates the velocity of the virtual listening point 102 by comparing the position information of the virtual listening point 102 at a certain time and after a predetermined time has lapsed, and extracts the velocity information of object 1 from the video/audio format 1510.

If only velocity information of virtual listening point is included in the video/audio format 1510, the relative velocity calculating section 1530 calculates the velocity of the object 1 by comparing the position information of the object 1 at a certain time and after a predetermined time has lapsed, and extracts the velocity information of the virtual listening point 102 from the video/audio format 1510.

Moreover, if the background is moving and has audio information, it is possible to consider the moving background as a moving object which is a sound source. In this case, it is possible to set another moving object as a virtual listening point.

Advantages of the Invention

As described in detail as above, according to the audio information transforming method of at least one embodiment, with respect to the object having the video/audio information constituting the scene that is replayed on the screen in the video/audio format such as MPEG 4, for example, the Doppler effect can be added to the audio information at the virtual listening point such that, for example, the frequency of the sound is increased if the object approaches the virtual listening point or the frequency of the sound is decreased if the object leaves the virtual listening point. Therefore, the audio environment with the strong appeal/reality, which enables the listener to feel that such listener just enters into the video (the virtual listening point), can be produced.

According to the audio information transforming method of at least one embodiment, the Doppler effect caused by the movement of the object can be calculated/processed easily by using the coded position information of the object. Therefore, the audio environment with the appeal/reality, which enables the listener to grasp such a situation that the object in the screen is moving from the virtual listening point by the audio, can be produced.

According to the audio information transforming method of at least one embodiment, there is no necessity to calculate the velocity of the object by the operation, and the burden of the calculating process can be reduced correspondingly. In addition, the processing speed can be improved.

According to the audio information transforming method of at least one embodiment, the Doppler effect caused by the movement of the virtual listening point can be calculated/processed easily by using the position information of the virtual listening point. Therefore, the audio environment with the appeal/reality, which enables the listener to grasp such a situation that the listener himself or herself (positioned at the virtual listening point) is moving by the audio, can be produced.

According to the audio information transforming method of leas one embodiment, there is no necessity to calculate the velocity of the virtual listening point by the operation, and the burden of the calculating process can be reduced correspondingly. In addition, the processing speed can be improved.

According to the audio information transforming method of least one embodiment, with respect to the scene that is replayed on the screen in the video/audio format such as DVD, for example, the Doppler effect is added to the audio information at the virtual listening point in response to the moving speed of the background. Therefore, the audio environment with the strong appeal/reality, which enables the listener to feel that such listener just enters into the video (the virtual listening point) and to grasp such a situation that the background of the screen is moving from the virtual listening point by the audio, can be produced.

According to the audio information transforming method of least one embodiment, in the case that the audio information including the Doppler effect previously is included in the object, first such Doppler effect included in the audio information is canceled, and then the Doppler effect is added to the audio information at the virtual listening point. Therefore, even if the Doppler effect is included in the audio information prior to the transformation, the Doppler effect caused when the object in the screen moves from the virtual listening point can be expressed precisely.

According to the audio information transforming method of leas one embodiment, in the case that the position information of the succeeding screen cannot be obtained at the time of the final image of the title that is now being replayed, for example, the audio frequency of the object, which is heard at the virtual listening point, can be calculated by using the formula of the audio frequency transformation that is obtained in audio frequency transformation processing in the preceding image of the final image. Therefore, such a possibility can be eliminated that the audio frequency transformation cannot be executed in the final image of the title, or the like because of lack of information.

According to the audio information transforming method of least one embodiment, when the reduced scale of the screen is changed by zoom-in, zoom-out, or the like of the replayed screen, the audio information transformation set forth in at least one otherembodiment can be executed precisely.

According to the video/audio format of least one embodiment, the velocity information of the object, the velocity information and the direction information of the scene, and the reduced scale information of the screen every scene are encoded by the encoder, and then these information are included in the video/audio format. Therefore, the audio information transformation set forth in at least one other embodiment can be implemented.

According to the audio information transforming program of least one embodiment, with respect to the object having the video/audio information constituting the scene that is replayed on the screen in the video/audio format such as MPEG 4, for example, the Doppler effect can be added to the audio information at the virtual listening point such that, for example, the frequency of the sound is increased if the object approaches the virtual listening point or the frequency of the sound is decreased if the object leaves the virtual listening point. Therefore, if the recording medium (the memory such as ROM, or the like) in which this program is recorded is employed the video/audio player (DVD player, LD player, game, MPEG player, system in the movie theater, etc.) that can produce the audio environment with the appeal/reality, which enables the listener to grasp such situation that the object in the screen is moving from the virtual listening point by the audio, can be implemented.

According to the audio information transforming program of least one embodiment, there is no necessity to calculate the velocity of the object by the operation, and the burden of the calculating process can be reduced correspondingly, and in addition the processing speed can be improved. Therefore, if the recording medium (the memory such as ROM, or the like) in which this program is recorded is employed, the video/audio player (DVD player, LD player, game, MPEG player, system in the movie theater, etc.) that can produce the audio environment with the appeal/reality, which enables the listener to grasp such a situation that the object in the screen is moving from the virtual listening point by the audio, can be implemented.

According to the audio information transforming program of least one embodiment, the Doppler effect caused by the movement of the virtual listening point can be calculated/processed easily by using the position information of the virtual listening point. Therefore, if the recording medium (the memory such as ROM, or the like) in which this program is recorded is employed, the video/audio player (DVD player, LD player, game, MPEG player, system in the movie theater, etc.) that can produce the audio environment with the appeal/reality, which enables the listener to grasp such a situation that the listener himself or herself (positioned at the virtual listening point) is moving by the audio, can be implemented.

According to the audio information transforming program of least one embodiment, there is no necessity to calculate the velocity of the virtual listening point by the operation, and the burden of the calculating process can be reduced correspondingly, and in addition the processing speed can be improved. Therefore, if the recording medium (the memory such as ROM, or the like) in which this program is recorded is employed, the video/audio player (DVD player, LD player, game, MPEG player, system in the movie theater, etc.) that can produce the audio environment with the appeal/reality, which enables the listener to grasp such a situation that the listener himself or herself is moving by the audio, can be implemented.

According to the audio information transforming program of least one embodiment, with respect to the scene that is replayed on the screen in the video/audio format such as DVD, for example, the Doppler effect is added to the audio information at the virtual listening point in response to the moving speed of the background. Therefore, if the recording medium (the memory such as ROM, or the like) in which this program is recorded is employed, the video/audio player (DVD player, LD player, game, MPEG player, system in the movie theater, etc.), which can produce the audio environment with the strong appeal/reality, can be implemented.

According to the audio information transforming program of least one embodiment even if the Doppler effect is included in the audio information prior to the transformation, the Doppler effect caused when the object in the screen moves from the virtual listening point can be expressed precisely. Therefore, if the recording medium (the memory such as ROM, or the like) in which this program is recorded is employed, the video/audio player (DVD player, LD player, game, MPEG player, system in the movie theater, etc.), which can produce the audio environment with the strong appeal/reality, can be implemented.

According to the audio information transforming program of least one embodiment, in the case that the position information of the succeeding screen cannot be obtained at the time of the final image of the title that is now being replayed, for example, the audio frequency of the object, which is heard at the virtual listening point, can be calculated by using the formula of the audio frequency transformation that is obtained in audio frequency transformation processing in the preceding image of the final image. Therefore, such a possibility can be eliminated that the audio frequency transformation cannot be executed in the final image of the title, or the like because of lack of information. As a result, if the recording medium (the memory such as ROM, or the like) in which this program is recorded is employed, the video/audio player (DVD player, LD player, game, MPEG player, system in the movie theater, etc.), which can produce the audio environment with the strong appeal/reality, can be implemented.

According to the audio information transforming program of least one embodiment, when the reduced scale of the screen is changed by zoom-in, zoom-out, or the like of the replayed screen, the audio information transformation can be executed precisely. Therefore, if the recording medium (the memory such as ROM, or the like) in which this program is recorded is employed, the video/audio player (DVD player, LD player, game, MPEG player, system in the movie theater, etc.), which can produce the audio environment with the strong appeal/reality, can be implemented.

According to the audio information transforming device of least one embodiment, with respect to the object having the video/audio information constituting the scene that is replayed on the screen in the video/audio format such as MPEG 4, for example, the Doppler effect can be added to the audio information at the virtual listening point such that, for example, the frequency of the sound is increased if the object approaches the virtual listening point or the frequency of the sound is decreased if the object leaves the virtual listening point. Therefore, if this audio information transforming device is employed, the audio environment with the strong appeal/reality, which enables the listener to feel that such listener just enters into the video (the virtual listening point), can be produced.

According to the audio information transforming device of least one embodiment, the audio environment with the appeal/reality, which enables the listener to feel that such listener just enters into the video (the virtual listening point) and to grasp such a situation that the object in the screen is moving from the virtual listening point by the audio or to grasp such a situation that the listener himself or herself is moving by the audio, can be produced.

According to the audio information transforming device the audio environment with the appeal/reality, which enables the listener to feel that such listener just enters into the video (the virtual listening point) and to grasp such a situation that the object in the screen is moving from the virtual listening point by the audio, can be produced.

According to the audio information transforming device of least one embodiment, the audio environment with the appeal/reality, which enables the listener to feel that such listener just enters into the video (the virtual listening point) and to grasp such a situation that the listener himself or herself (positioned at the virtual listening point) is moving by the audio, can be produced.

According to the audio information transforming device of least one embodiment, with respect to the scene that is replayed on the screen in the video/audio format such as DVD, for example, the Doppler effect is added to the audio information at the virtual listening point in response to the moving speed of the background. Therefore, the audio environment with the appeal/reality, which enables the listener to feel that such listener just enters into the video (the virtual listening point) and to grasp such a situation that the background of the screen is moving from the virtual listening point by the audio, can be produced.

What is claimed is:

1. An audio information transforming method applied to a video/audio format in which a screen includes a plurality of objects and each object has video information, position information, and audio information, said method comprising the steps of:

virtual listening point setting of setting a virtual listening point at a position different from a basic listening point that is set as a position at which a listener listens to an audio;

relative velocity calculating of calculating a relative velocity between the virtual listening point and the object; and audio frequency transforming of executing an audio frequency transformation based on the relative velocity to add a Doppler effect to the audio information at the virtual listening point, wherein, when the audio information including the Doppler effect previously is included in the object, the audio frequency transforming step executes an audio frequency transformation to cancel the Doppler effect included in the audio information of the object, and executes the audio frequency transformation based on the relative velocity to add the Doppler effect to the audio information of the virtual listening point.

2. An audio information transforming method applied to a video/audio format in which a screen includes a plurality of objects and each object has video information, position information, and audio information, said method comprising the steps of:

virtual listening point setting of setting a virtual listening point at a position different from a basic listening point that is set as a position at which a listener listens to an audio;

relative velocity calculating of calculating a relative velocity between the virtual listening point and the object; and audio frequency transforming of executing an audio frequency transformation based on the relative velocity to add a Doppler effect to the audio information at the virtual listening point, said format comprising:

velocity information of an object, said object is one of objects included on a screen;

velocity information and direction information of a scene which is replayed on the screen; and reduced scale information of the screen every scene.

3. An audio information transforming method applied to a video/audio format in which a screen includes a plurality of objects and each object has video information, position information, and audio information, said method comprising the steps of:

virtual listening point setting of setting a virtual listening point at a position different from a basic listening point that is set as a position at which a listener listens to an audio;

relative velocity calculating of calculating a relative velocity between the virtual listening point and the object; and audio frequency transforming of executing an audio frequency transformation based on the relative velocity to add a Doppler effect to the audio information at the virtual listening point, said encoder for encoding:

velocity information of an object, which is one of objects included in a screen;

velocity information and direction information of a scene; and reduced scale information of the screen every scene.

4. An audio information transforming method applied to a video/audio format in which each scene that is replayed on a screen has video information and audio information, and the scene has velocity information and direction information based on which a background is moved, said method comprising the steps of:

virtual listening point setting step of setting a virtual listening point at a position different from a basic listening point that is set as a position at which a listener listens to an audio;

relative velocity calculating step of calculating a relative velocity between the virtual listening point and a background based on the velocity information and the direction information of the background; and audio frequency transforming step of transforming an audio frequency based on the relative velocity to add a Doppler effect to the audio information at the virtual listening point, said format comprising at least one of:

velocity information of an object, said object is one of objects included on a screen;

velocity information and direction information of a scene which is replayed on the screen; and reduced scale information of the screen every scene.

5. An audio information transforming method applied to a video/audio format in which each scene that is replayed on a screen has video information and audio information, and the scene has velocity information and direction information based on which a background is moved, said method comprising the steps of:

virtual listening point setting step of setting a virtual listening point at a position different from a basic listening point that is set as a position at which a listener listens to an audio;

relative velocity calculating step of calculating a relative velocity between the virtual listening point and a background based on the velocity information and the direction information of the background; and audio frequency transforming step of transforming an audio frequency based on the relative velocity to add a Doppler effect to the audio information at the virtual listening point.

said format comprising at least one of:

velocity information of an object, said object is one of objects included on a screen;

velocity information and direction information of a scene which is replayed on the screen; and reduced scale information of the screen every scene.

* * * * *